US009754543B2

(12) United States Patent
Ma et al.

(10) Patent No.: US 9,754,543 B2
(45) Date of Patent: Sep. 5, 2017

(54) IMAGE SELF-CALIBRATION METHOD AND DEVICE FOR LCD DISPLAYS

(71) Applicants: Chih-Hung Ma, New Taipei (TW); Tsung-Lung Yang, New Taipei (TW); Chih-Wei Kuo, New Taipei (TW); Shih-Pang Wang, New Taipei (TW); Meng-Han Tsai, New Taipei (TW)

(72) Inventors: Chih-Hung Ma, New Taipei (TW); Tsung-Lung Yang, New Taipei (TW); Chih-Wei Kuo, New Taipei (TW); Shih-Pang Wang, New Taipei (TW); Meng-Han Tsai, New Taipei (TW)

(73) Assignee: Panoramic Imaging Solutions Ltd., New Taipei (TW)

( * ) Notice: Subject to any disclaimer, the term of this patent is extended or adjusted under 35 U.S.C. 154(b) by 106 days.

(21) Appl. No.: 14/688,097

(22) Filed: Apr. 16, 2015

(65) Prior Publication Data

US 2016/0307485 A1 Oct. 20, 2016

(51) Int. Cl.
*G09G 3/36* (2006.01)
*G09G 3/20* (2006.01)

(52) U.S. Cl.
CPC ..... *G09G 3/36* (2013.01); *G09G 3/20* (2013.01); *G09G 2320/066* (2013.01); *G09G 2320/0666* (2013.01); *G09G 2320/0693* (2013.01); *G09G 2320/08* (2013.01); *G09G 2360/145* (2013.01)

(58) Field of Classification Search
CPC ..... G09G 3/36
USPC ..... 345/88
See application file for complete search history.

(56) References Cited

U.S. PATENT DOCUMENTS 6,611,249 B1 * 8/2003 Evanicky ..... G01J 3/02 345/102
2011/0042071 A1 * 2/2011 Hsu ..... E21B 47/102 166/250.01
2011/0248975 A1 * 10/2011 Takuma ..... G09G 3/3225 345/207
2014/0192209 A1 * 7/2014 Yin ..... G09G 3/006 348/191
2015/0296589 A1 * 10/2015 Melanson ..... H05B 33/0821 315/151

* cited by examiner

*Primary Examiner* — Jason Olson

(57) ABSTRACT

The present invention provides an image self-calibration method and device for LCD displays, comprising a front optical sensor and a calibration reference device. The front optical sensor is employed to calibrate the gray scale level and color temperature of the display. The calibration reference device is employed to pre-calibrate the front optical sensor. The present invention has the following advantages. Image pre-calibration is performed on the installed optical sensor before it leaves a factory, and the calibrated optical sensor directly performs gray scale level and color temperature calibration on the display. The present invention is easy to implement, can effectively inspect and calibrate images on the display, and can save human resources and reduce manufacture and maintenance time.

8 Claims, 2 Drawing Sheets

IMAGE SELF-CALIBRATION METHOD AND DEVICE FOR LCD DISPLAYS

BACKGROUND OF THE INVENTION

1. Field of the Invention

The present invention relates to an image self-calibration method and device for LCD displays that saves human resources and reduces manufacture and maintenance time.

2. Description of Related Art

Current technology applied in image calibration for displays may be classified into two types: hardware calibration and software calibration. Hardware calibration stores calibrated data in a storage device inside a display, while software calibration performs image calibration using a computer with built-in ICC profile.

Both hardware calibration and software calibration for conventional displays require equipment such as computer and colorimeter as well as professional software for display calibration. On some occasions it is not convenient to set up these external devices, for example for a wall display already embedded or a display in an operation room. In particular, for medical equipment that are intensively used and that require high-standard images, maintenance cost of external devices and professional software is high.

However, each display panel is slightly different when manufactured. They have slightly different physical properties and maximum luminance. Gamma correction and color temperature compensation further increase differences in their luminance. Especially the display for medical diagnosis that require precise image presentation in gray scale level, Gamma value, luminance, and chromaticness. This invention is to ensure display system working properly, and to make sure physicians read medical images in good quality while performing medical diagnosis and report.

The prior art disclosed in Taiwan patent publication No. 200627369 only provides a method for calibrating image color temperature, wherein images are recorded via physical characteristics of electronic circuits.

SUMMARY OF THE INVENTION

To solve the foregoing problems, the present invention employs an optical sensor accompanied by sensing elements disposed on a display. The optical sensor is calibrated before leaving a factory so that image self-calibration may be performed by the display itself without need of any external device and software. The present invention may be applied on occasions when it is not convenient to set up external devices and may reduce corrective maintenance cost of displays.

The primary purpose of the present invention is to provide an image self-calibration method for LCD displays which employs a front optical sensor disposed on the display to calibrate the gray scale level and color temperature of the display. The optical sensor will be pre-calibrated before use to maintain stable and consistent reference values.

Further, the foregoing method specifically includes the following steps: (1) set up a front optical sensor on a display; (2) calibrate the front optical sensor with a calibration reference device; (3) the front optical sensor calibrates the gamma value and color temperature of the display.

The present invention further provides an image self-calibration device for LCD displays comprising a front optical sensor disposed in front of an LCD display panel and a calibration reference device disposed in a middle of the LCD display. The calibration reference device and the display are connected to a computer. The front optical sensor is employed to calibrate the gray scale level and color temperature of the display. The calibration reference device is employed to pre-calibrate the front optical sensor.

The present invention has the following advantages. Image pre-calibration is performed on the installed optical sensor before it leaves a factory, and the calibrated optical sensor directly performs gray scale level and color temperature calibration on the display. The present invention is easy to implement and can effectively inspect and calibrate images on displays.

DETAILED DESCRIPTION OF THE PREFERRED EMBODIMENTS

Figure 1:
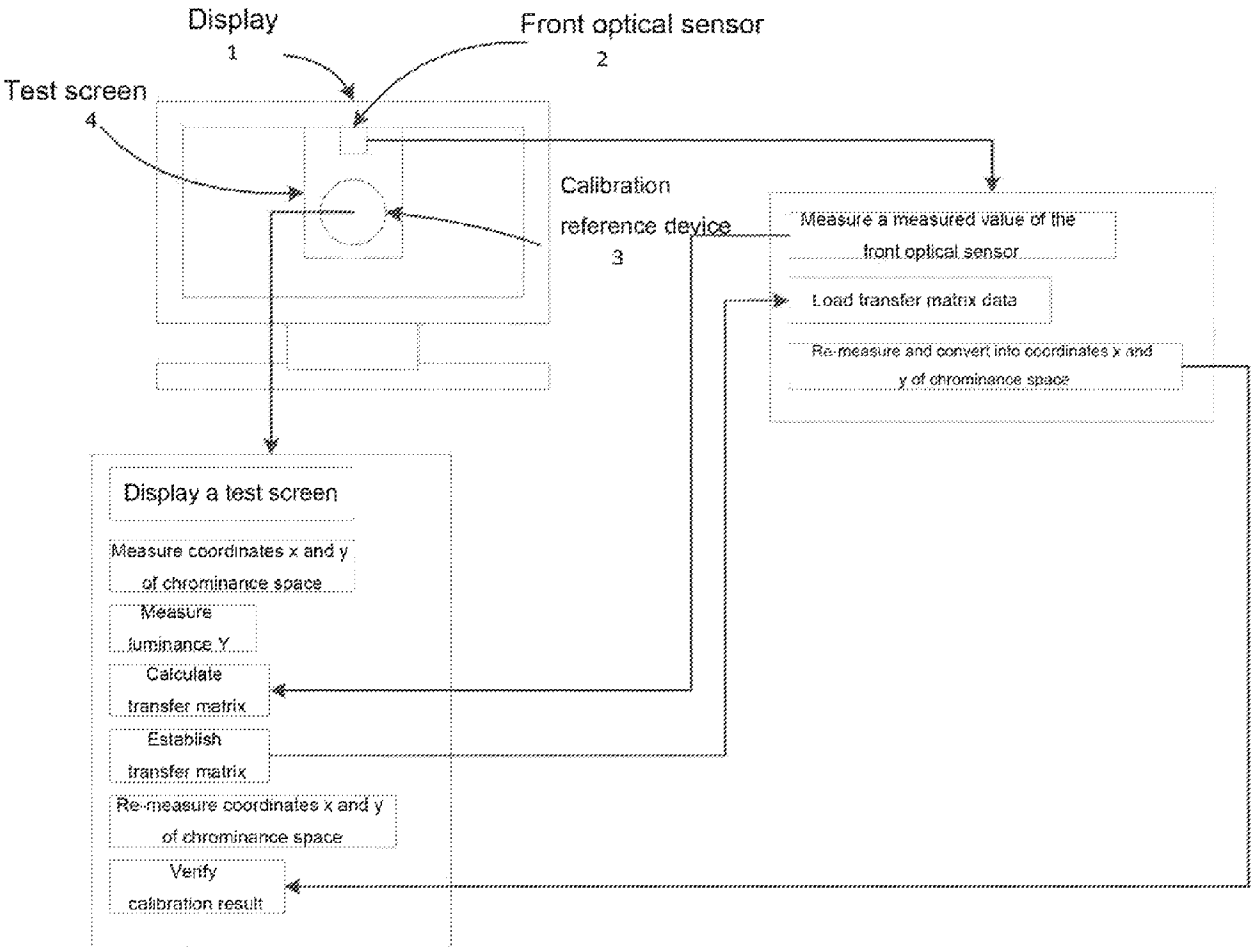
FIG. 1 is a schematic view of image calibration performed on a front optical sensor according to the present invention.
Figure 2:
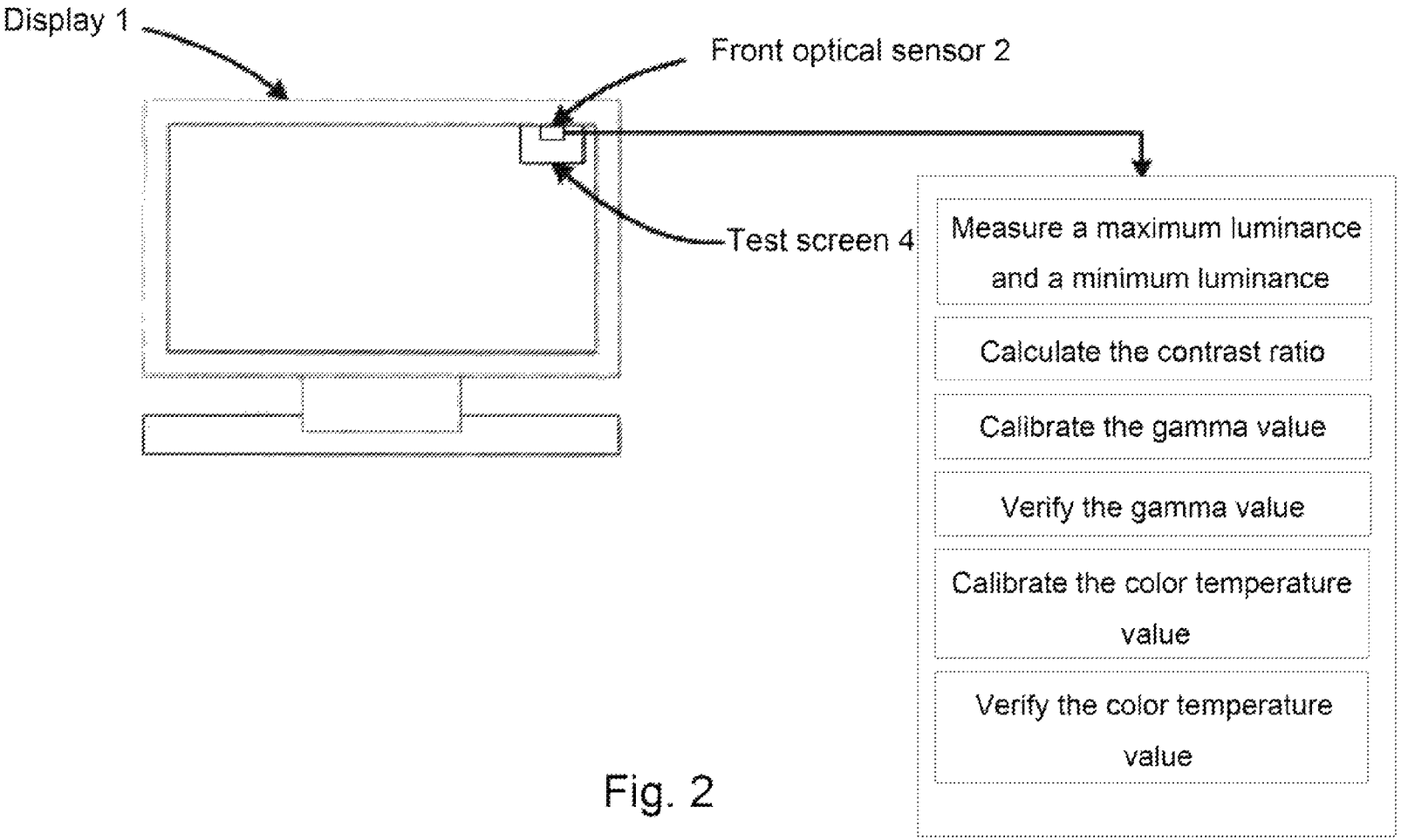
FIG. 2 is a schematic view of image self-calibration performed by the front optical sensor itself according to the present invention.

The foregoing purposes of the present invention along with its structure and performance characteristics are further illustrated in the following description of specific embodiments in conjunction with the accompanying figures. Please refer to FIGS. 1 and 2.

The present invention is illustrated in a flow diagram and a schematic flow diagram including the following three steps.

Step 1: set up a front optical sensor on a display. A front optical sensor 2 is disposed in front of an LCD display 1 panel, and the front optical sensor 2 is coupled to a calibration unit, and the calibration unit is coupled to the LCD display 1 to prevent LCD display panel degradation from causing luminance attenuation, so that measurement data may be more accurate. It should be noted that the calibration unit is not limited to PC(personal computer). For example, the calibration unit could be a circuit, chip, chipset, processor, computer, server, cloud computing or the combination thereof of the hardware, software or firmware which could use the method of image self-calibration for LCD displays in present invention.

Step 2: calibrate the front optical sensor, perform the following steps to get measurement data, and compare the measurement data with those obtained by the calibration reference device 3. When the difference between the measurement data and the calibration reference device 3 is smaller than the margin of error, Delta E (2000)<5, the calibration is successful. According to the content published in COLOR research and application Volume 30, Number 1, February 2005 p. 21~30, Delta E (2000) is indicated to be a standard unit of measurement further defined in 2000 year by CIE for presenting the color difference, the CIE is the international commission on illumination. According to the general acknowledgement in the field of the present invention, when Delta E (2000)<1, the human eye can not judge the color difference. When 1<Delta E(2000)<3, the human eye almost can not judge the color difference. When 3<Delta E(2000)<6, it is difficult to discover the color difference without comparing. When Delta E(2000)>6, the human eye can discover the color difference without comparing. Therefore the requirement of the general professional display spec is the average Delta E(2000)≤5.

A. Set up a colorimeter or a spectrometer in an appropriate position on the display to serve as a calibration reference device 3;

B. Connect the display 1 and the calibration reference device 3 to a computer;

C. Calibrate the luminance of the display 1 to a minimum value within a range of application and display a completely black test screen. After the luminance becomes stable, the optical sensor 2 measures Red, Green, and Blue channels and the obtained data is $$\begin{bmatrix} R_0 \\ G_0 \\ B_0 \end{bmatrix},$$

while the calibration reference device 3 measures the coordinates x and y of chrominance space and luminance (brightness) Y and the obtained data is $$\begin{bmatrix} x_0 \\ y_0 \\ Y_0 \end{bmatrix};$$

D. Display a test screen 4 on the display 1. The calibration reference device 3 measures the coordinates x and y of chrominance space and luminance (brightness) Y and stores the measured data. Simultaneously the front optical sensor measures the Red, Green, and Blue channels and the clear channel and stores the measured data:

Test screen in application: rgb=(255 0 0), rgb=(0 255 0), rgb=(0 0 255)

Three sets of measured data of three test screens obtained by the calibration reference device $$\begin{bmatrix} x_R \\ y_R \\ Y_R \end{bmatrix}, \begin{bmatrix} x_G \\ y_G \\ Y_G \end{bmatrix}, \begin{bmatrix} x_B \\ y_B \\ Y_B \end{bmatrix} \quad 3$$

Measured data obtained by the corresponding front optical sensor:

$$\begin{bmatrix} R_R \\ G_R \\ B_R \end{bmatrix}, \begin{bmatrix} R_G \\ G_G \\ B_G \end{bmatrix}, \begin{bmatrix} R_B \\ G_B \\ B_B \end{bmatrix};$$

E. Apply the relation equation of chrominance space and color stimulus, wherein the x and y in the equation are coordinates of chrominance space and the X. Y, and Z are color stimulus:

$$\begin{cases} x = \dfrac{X}{(X+Y+Z)} \\ y = \dfrac{Y}{(X+Y+Z)} \end{cases} \begin{cases} X = \dfrac{x}{y}Y \\ Y = Y \\ Z = \dfrac{1-x-y}{y}Y \end{cases} \quad \text{Equation 1}$$

Transfer the measured data obtained in steps 3 and 4 by the calibration reference device 3 into color stimulus and get four sets of color stimulus:

$$\begin{bmatrix} X_0 \\ Y_0 \\ Z_0 \end{bmatrix}, \begin{bmatrix} X_R \\ Y_R \\ Z_R \end{bmatrix}, \begin{bmatrix} X_G \\ Y_G \\ Z_G \end{bmatrix}, \begin{bmatrix} X_B \\ Y_B \\ Z_B \end{bmatrix};$$

F. Establish a transfer matrix between the measured data obtained by the front optical sensor and the color stimulus obtained in step 4. Get a transfer matrix coefficient and establish a conversion equation:

$$\begin{bmatrix} X_{ref} \\ Y_{ref} \\ Z_{ref} \end{bmatrix} = M_{3\times3} \times \begin{bmatrix} R_{mes} - R_0 \\ G_{mes} - G_0 \\ B_{mes} - B_0 \end{bmatrix} + \begin{bmatrix} X_0 \\ Y_0 \\ Z_0 \end{bmatrix}, \quad \text{Equation 2}$$

wherein $$\begin{bmatrix} X_{ref} \\ Y_{ref} \\ Z_{ref} \end{bmatrix}$$

is the color stimulus, and $$\begin{bmatrix} R_{mes} \\ G_{mes} \\ B_{mes} \end{bmatrix}$$

is the measured data obtained by the front optical sensor;

Enter into the conversion equation the measured data obtained by the front optical sensor and the color stimulus measured and converted by the calibration reference device 3 at steps 3, 4, and 5and get the transfer matrix M.

$$\begin{bmatrix} X_R \\ Y_R \\ Z_R \end{bmatrix} = M_{3\times3} \times \begin{bmatrix} R_R - R_0 \\ G_R - G_0 \\ B_R - B_0 \end{bmatrix} + \begin{bmatrix} X_0 \\ Y_0 \\ Z_0 \end{bmatrix} \quad \text{Equation 3}$$

$$\begin{bmatrix} X_G \\ Y_G \\ Z_G \end{bmatrix} = M_{3\times3} \times \begin{bmatrix} R_G - R_0 \\ G_G - G_0 \\ B_G - B_0 \end{bmatrix} + \begin{bmatrix} X_0 \\ Y_0 \\ Z_0 \end{bmatrix}$$

$$\begin{bmatrix} X_B \\ Y_B \\ Z_B \end{bmatrix} = M_{3\times3} \times \begin{bmatrix} R_B - R_0 \\ G_B - G_0 \\ B_B - B_0 \end{bmatrix} + \begin{bmatrix} X_0 \\ Y_0 \\ Z_0 \end{bmatrix};$$

G. Display other test screens on the display and measure them by the front optical sensor to obtain measured data. Convert the measured data into x, y, and Y via equations 4, 2, and 1. Compare x, y, and Y with the measured data obtained by the calibration reference device 3. When the difference between them is smaller than the margin of error, the calibration is successful.

Step 3: the front optical sensor calibrates the display.

A. Measure a minimum luminance value $L_{min}$ and a maximum luminance value $L_{max}$ of the display by the front optical sensor. Calculate the contrast ratio $C=L_{max}/L_{min}$ of the display to confirm that it corresponds to the specifications of DICOM (Digital imaging and communications in medicine);

B. Calibrate the gamma value by performing the following steps:

a. Control and calibrate a backlight of the display to an appropriate luminance with feedback from the front optical sensor. The luminance must be greater than a minimum luminance as specified in DICOM;

b. Show a 32-level gray scale test screen on the display, which is measured and recorded by the front optical sensor to serve as a reference luminance. Also, establish a luminance characteristic curve;

c. Based on the requirements of display chip, interpolate the reference luminance by performing cubic spline interpolations and get the luminance reference table required by the display chip. The size of the luminance reference table is n, and actually n is decide by the number of Gamma table bit, for example, if the number of Gamma table bit is 10 bit, n is 1024;

d. Use the target gamma value and gamma value equation 5 to calculate the luminance value required for each level. Select a nearest corresponding level from the luminance reference table and enter it into the gamma table.

$$L(x)=L_0+(L_{n-1}-L_0)\times(x/n)^{65}\ x=0,1\ldots n-1;\text{ and} \qquad \text{Equation 5}$$

e. Firmware of the display loads the gamma table obtained in step 4 and measures the gray scale curve again to verify whether the result of the calibration is correct and complete gamma calibration.

C: Calibrate the color temperature by performing the following steps:

a. Control and calibrate a backlight of the display to an appropriate luminance with feedback from the front optical sensor. The luminance must be greater than a minimum luminance as specified in DICOM;

b. Show a completely white test screen on the display. The front optical sensor uses the transfer matrix to measure the coordinates x and y of the current chrominance space and luminance (brightness) Y of the display, and Red, Green, Blue gain values of the display in the temporary storage. R-Gain is directly proportional to the x in color coordinates (x, y) which corresponds to the color temperature, G-Gain is directly proportional to y, and B-Gain is inversely proportional to x and y. Further, R-Gain. G-Gain, B-Gain and the luminance Y satisfy the following equation: Y=0.299*R Gain+0.587*G Gain+0.114*B Gain. Hence, calibrate the R-Gain, G-Gain, and B-Gain of the display in the temporary storage to calibrate the color temperature of the display screen;

c. Firmware of the display loads the R-Gain, G-Gain, and B-Gain values and measures the coordinates x and y of the chrominance space and luminance (brightness) Y of the display again to verify whether they fall within a margin of tolerable error and complete color temperature calibration.

The present invention performs image pre-calibration on an installed front optical sensor and uses the front optical sensor to directly calibrate the gray scale level and color temperature of the display. The present invention is easy to implement and can effectively inspect and calibrate images on the display.

The foregoing preferred embodiments of the present invention are illustrated of the present invention rather than limiting of the present invention. It is intended to cover various modifications and changes included within the spirit and scope of the appended claims, the scope of which should be accorded the broadest interpretation so as to encompass all such modifications and similar structures.

What is claimed is:

1. A method of image self-calibration for LCD displays, comprising:

(1) set up a front optical sensor on a display, the front optical sensor is coupled to a calibration unit, and the calibration unit is coupled to the display;

(2) calibrate the front optical sensor with a calibration reference device and a computer coupled to the calibration reference device, this step further includes the following steps:

(21) set up the calibration reference device in front of the display;

(22) connect the display and the calibration reference device to the computer;

(23) display a test screen on the display, and the calibration reference device measures the coordinates x and y of chrominance space and luminance Y and stores a first measured data on the computer, and the front optical sensor measures the display and stores a second measured data;

(24) enter the first measured data obtained by the calibration reference device in step

(23) into a relation equation of the chrominance space and color stimulus to get color stimulus;

(25) establish a transfer matrix between the second measured data obtained by the front optical sensor in step (23) and the color stimulus obtained in step (24) to get a transfer matrix coefficient;

(26) display other test screens on the display and measure them by the front optical sensor to obtain a third measured data, and then convert the third measured data into coordinates of chrominance space and luminance, following the converting, compare them with the first measured data obtained by the calibration reference device, and after the comparing, when the difference between them is smaller than a margin of error, Delta E (2000)<5, the calibration is successful, and the Delta E (2000) is indicated to be a standard unit of measurement defined in 2000 year by CIE for presenting the color difference, the CIE is the international commission on illumination; and (3) calibrate the gamma value or color temperature of the display with the calibration unit, based on data measured by the front optical sensor.

2. The method of image self-calibration for LCD displays as defined in claim 1, wherein the calibration reference device is a colorimeter or a spectrometer.

3. The method of image self-calibration for LCD displays as defined in claim 1, wherein gamma value calibration performed by the front optical sensor includes the following steps:

(311) control and calibrate a backlight of the display with feedback from the front optical sensor with the calibration unit, so that its luminance is greater than a minimum luminance as specified in DICOM, and DICOM is Digital imaging and communications in medicine;

(312) show a test screen on the display, which is measured and recorded by the front optical sensor to serve as a reference luminance, and also, establish a luminance characteristic curve based on the reference luminance by the calibration unit;

(313) based on the requirements of display chip, interpolate the reference luminance based on at least one display chip, and get the luminance reference table required by the display chip, and the size of the luminance reference table is n, and n is based on the number of Gamma table bit;

(314) use the target gamma value and gamma value equation, $L(x)=L_0+(L_{n-1}-L_0)\times(x/n)^{\gamma}$, x=0,1 . . . n−1, to calculate the luminance value required for each level, and select a nearest corresponding level from the luminance reference table and enter it into the gamma table, n is a Entry number of a Gamma LUT, L(x) is a luminance of x level, $L_{n-1}$ is a luminance of n−1 level, $L_0$ is a luminance of 0 level, γ is a gamma value; and (315) firmware of the display loads the gamma table obtained in step (314) and measures the gray scale curve again to verify whether the result of the calibration is correct and complete gamma calibration.

4. The method of image self-calibration for LCD displays as defined in claim 3, wherein the following steps are further included before step (311):

measure a minimum luminance value L min and a maximum luminance value L max of the display by the front optical sensor Calculate the contrast ratio C=L max/L min of the display to confirm that it corresponds to the specifications of DICOM.

5. The method of image self-calibration for LCD displays as defined in claim 3, wherein in step (313) the reference luminance is interpolated by cubic spline interpolations.

6. The method of image self-calibration for LCD displays as defined in claim 1, wherein color temperature calibration performed by the front optical sensor includes the following steps:

(321) control and calibrate a backlight of the display with feedback from the cooperation by the front optical sensor and the calibration unit, so that the luminance is greater than a minimum luminance as specified in DICOM;

(322) show a test screen on the display, and the front optical sensor obtains measured data and uses a transfer matrix to measure the coordinates of the current chrominance space and luminance of the display, and then calibrate the R-Gain, G-Gain, and B-Gain of the display in the temporary storage to calibrate the color temperature of the display screen based on a relation between the R-Gain, G-Gain, and B-Gain and coordinates of chrominance space;

(323) firmware of the display loads the calibrated R-Gain, G-Gain, and B-Gain values and measures the coordinates of the chrominance space and luminance of the display again to verify whether they fall within a margin of tolerable error, Delta E (2000)<5, and complete color temperature calibration.

7. An image self-calibration device for LCD displays, comprising a front optical sensor disposed in front of an LCD display panel and coupled to a calibration unit, and a calibration reference device disposed in a middle of the LCD display, and the calibration reference device and the display are connected to a computer, and the calibration unit is employed to calibrate the gray scale level and color temperature of the display, based on data measured by the front optical sensor, and the calibration reference device is employed to pre-calibrate the front optical sensor, wherein the calibration unit and the calibration reference device calibrate the front optical sensor as following: set up the calibration reference device in front of the display; connect the display and the calibration reference device to the computer; display a test screen on the display, and the calibration reference device measures the coordinates x and y of chrominance space and luminance Y and stores a first measured data on the computer, and the front optical sensor measures the display and stores a second measured data; enter the first measured data obtained by the calibration reference device into a relation equation of the chrominance space and color stimulus to get color stimulus; establish a transfer matrix between the second measured data obtained by the front optical sensor and the color stimulus obtained to get a transfer matrix coefficient; display other test screens on the display and measure them by the front optical sensor to obtain a third measured data, and then convert the third measured data into coordinates of chrominance space and luminance, following the converting, compare them with the first measured data obtained by the calibration reference device, and after the comparing, when the difference between them is smaller than a margin of error, Delta E (2000)<5, the calibration is successful, and the Delta E (2000) is indicated to be a standard unit of measurement defined in 2000 year by CIE for presenting the color difference, the CIE is the international commission on illumination.

8. The image self-calibration device for LCD displays as defined in claim 7, wherein the calibration reference device is a colorimeter or a spectrometer.

* * * * *